United States Patent [19]

Mori

[11] 4,397,233

[45] Aug. 9, 1983

[54] AUTOMATIC NUMBERING ASSEMBLY

[75] Inventor: Koukichi Mori, Tokyo, Japan

[73] Assignee: Kabushiki Kaisha Morico, Tokyo, Japan

[21] Appl. No.: 243,807

[22] Filed: Mar. 16, 1981

[30] Foreign Application Priority Data

Mar. 17, 1980 [JP] Japan ..... 55-33661[U]
Mar. 17, 1980 [JP] Japan ..... 55-33662[U]

[51] Int. Cl.[3] ..... B41F 17/26
[52] U.S. Cl. ..... 101/35; 101/87
[58] Field of Search ..... 101/35, 85–88, 101/250, 275, 276, 248; 279/4; 29/113

[56] References Cited

U.S. PATENT DOCUMENTS

| | | | |
|---|---|---|---|
| 3,250,542 | 5/1966 | Winnen et al. | 279/4 |
| 3,378,902 | 4/1968 | Hoexter | 29/113 |
| 3,808,970 | 5/1974 | Delligatti | 101/35 |
| 4,068,578 | 1/1978 | Delligatti | 101/35 |
| 4,129,074 | 12/1978 | Beaver et al. | 101/35 |

*Primary Examiner*—Edward M. Coven
*Attorney, Agent, or Firm*—Fleit, Jacobson & Cohn

[57] ABSTRACT

The invention relates to an automatic numbering printer assembly having a rotatable printing head and a motion feeler arm extending outwardly from the printing head and a successively numbering digit wheel unit positioned with the head. The printing head is fitted with a hydraulic lock and unlock unit for allowing, when it is unlocked, a relative angular adjustment of a digit wheel of the digit wheel unit relative to the printing head.

2 Claims, 9 Drawing Figures

AUTOMATIC NUMBERING ASSEMBLY

BACKGROUND OF THE INVENTION

This invention relates to an automatic numbering unit adapted for operation successively by a series of moving packages, a series of numbers or the like symbols being printed on the packages by the numbering unit.

These kinds of automatic numbering printers are already known. For instance, such printers are described in Japanese Utility Model Publications Nos. Sho-50-7926; Sho-50-2927 and Sho-50-2928, respectively.

It has been experienced, however, that in these conventional numbering printers, the print-starting position relative to the passing package can not practically be adjusted.

SUMMARY OF THE INVENTION

It is a main object of the present invention to provide an improved automatic numbering printer which provides an adjustability of the print-starting position of the machine relative to the passing packages.

This and further objects, features and advantages of the invention will become more apparent when reading the following detailed description of the invention by way of an example of conventional arts and a preferred embodiment of the present invention, shown in the accompanying drawings.

DETAILED DESCRIPTION OF THE INVENTION

Figure 1:
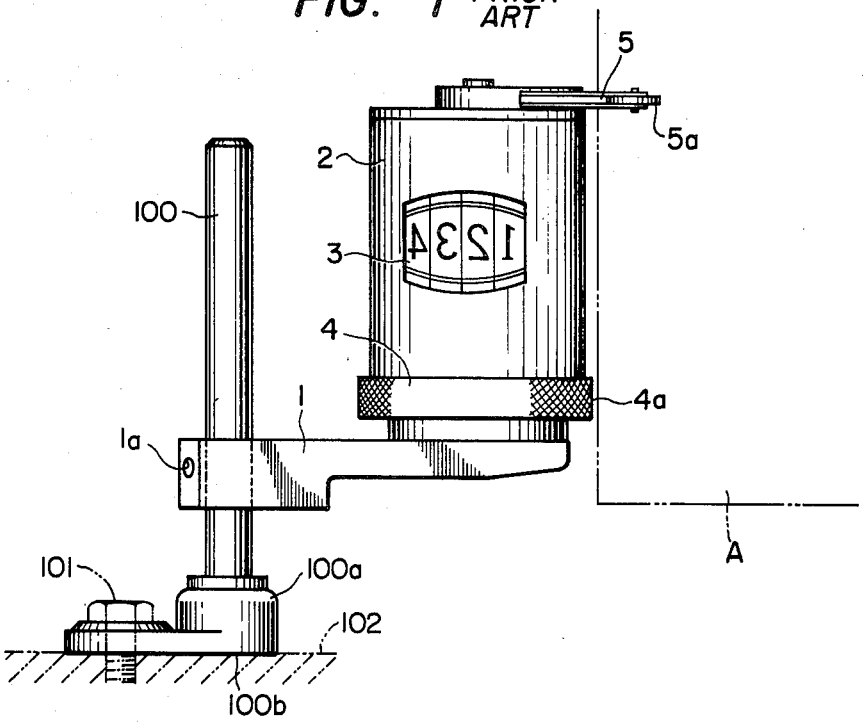
FIG. 1 PRIOR ART
FIG. 1 is a front view of a conventional numbering printer upon which the inventive idea can be applied.
Figure 4:
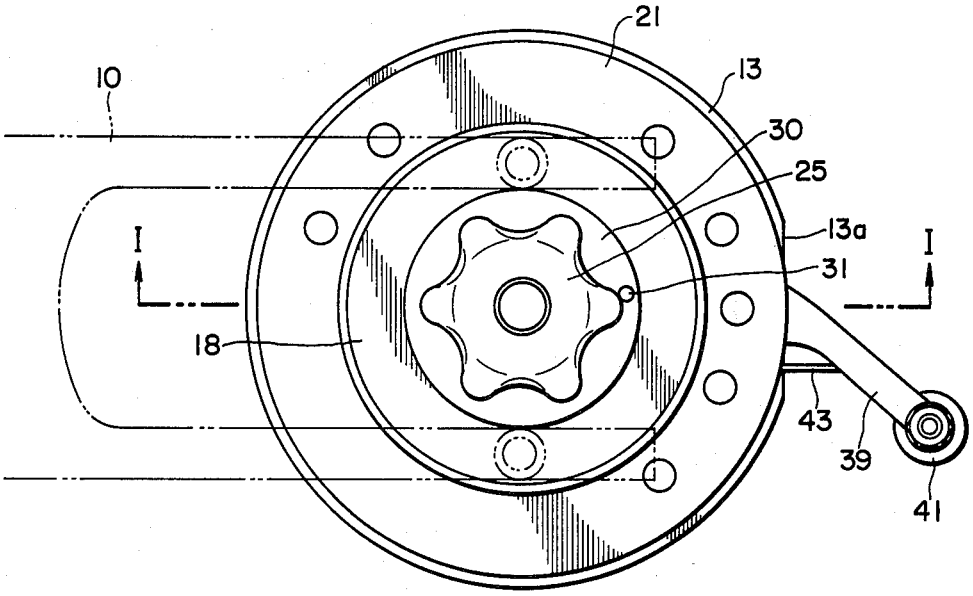
FIG. 4 is a top plan view of the printing drum constituting the main portion of the embodiment illustrated in FIG. 3.

Referring now to the accompanying drawings, numeral 100 represents a vertically arranged guide and support bar or post, a root base portion 100*a* being fixedly attached to the lower end of the said guide bar. The base 100*a* has a flat bottom surface positioned at a properly selected position by sliding it on a smooth horizontal floor 102 and fixed thereat by tightening a fixing bolt 101 passing through the base 100*a*.

A horizontally extending support arm 1 is slidable along the post 100 and fixed thereto at a properly selected height measured from the floor 102. For this purpose, the root end of the arm 1 is formed into a split structure, so as to embrace the post 100, or more specifically, so as to embrace the latter in a slightly elastic relationship, although not specifically shown in the drawing. This split root end of the arm 1 has a pair of slots 1*a* for passing therethrough a tightening screw, not shown, adapted for positioning the said arm at a certain height from the floor surface 102.

Numeral 2 represents a printing drum which is rotatably mounted on the arm 1.

Figure 3:
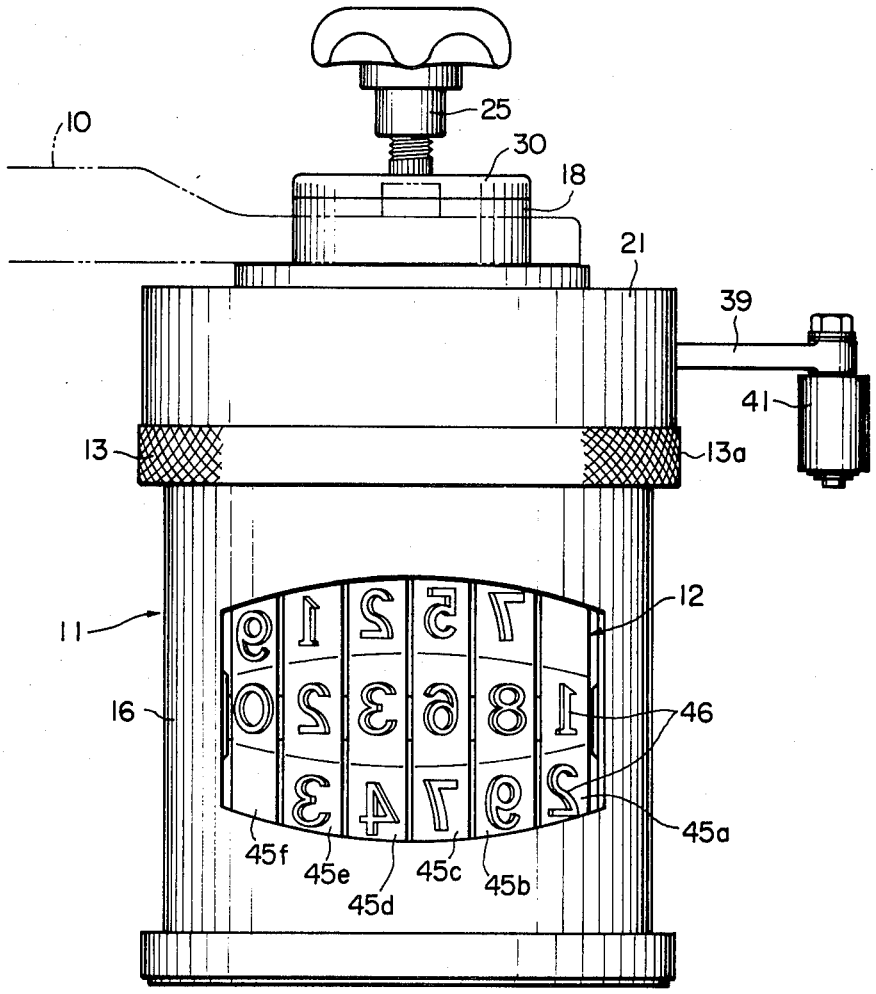
FIG. 3 is an enlarged side elevational view of essential parts of one embodiment of the improved numbering printer according to the present invention.
Figure 9:
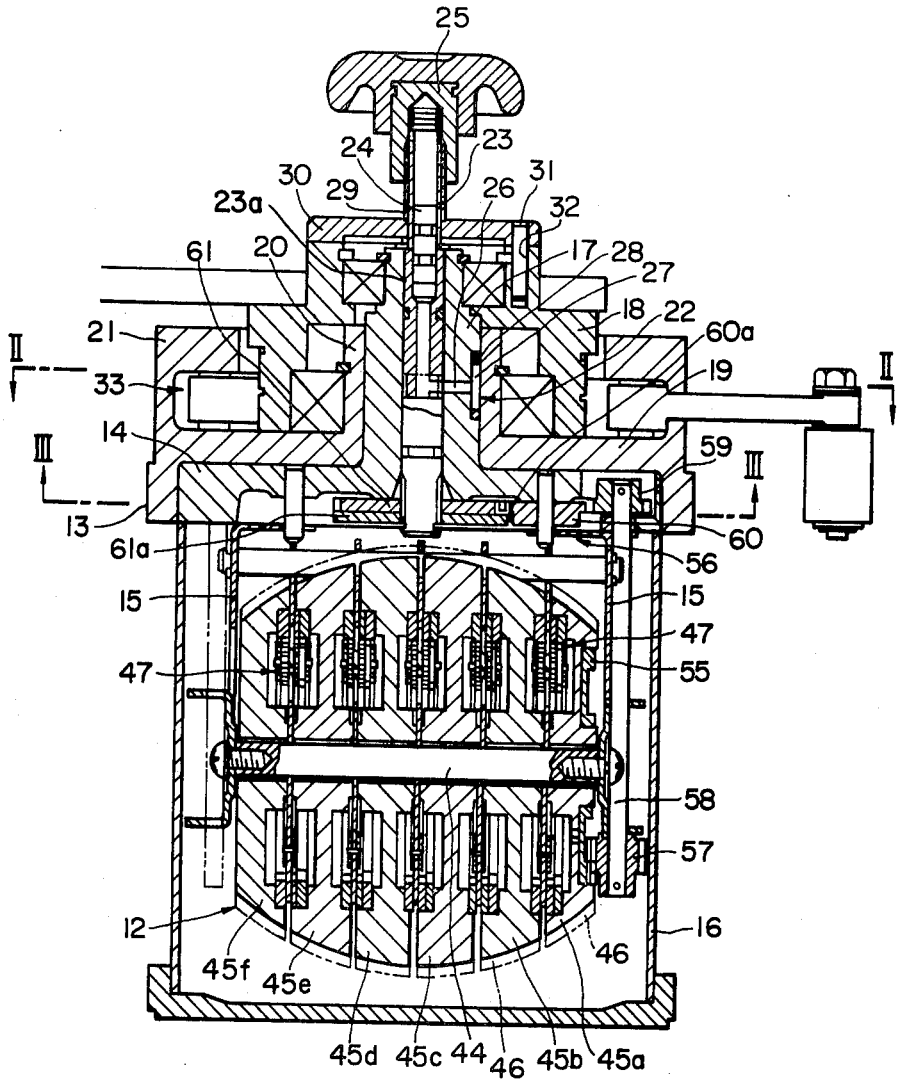
FIG. 9 is a longitudinally sectioned, axial elevation of the printing drum.

In the foregoing, the drum 2 is supported at its bottom end on the arm 1. However, if necessary, the drum can be supported in a suspended manner from the said arm, as shown in FIGS. 3 and 9.

Numeral 3 represents a character array having several series of printing character elements, generally shown at 3. These character elements naturally protrude slightly from the outer cylindrical surface of the drum.

Numeral 4 represents a serrated or the like frictionally contactable ring which is fixedly attached to the cylindrical outer surface of the drum, so as to establish a frictional contact with the package "A" for receiving a rotary drive movement therefrom, as will be later more fully described. This friction ring 4 is mounted near the lower end of the drum. However, the ring band 4 could be provided near the upper end of the drum. In this respect, refer to FIGS. 3 and 9.

Figure 2:
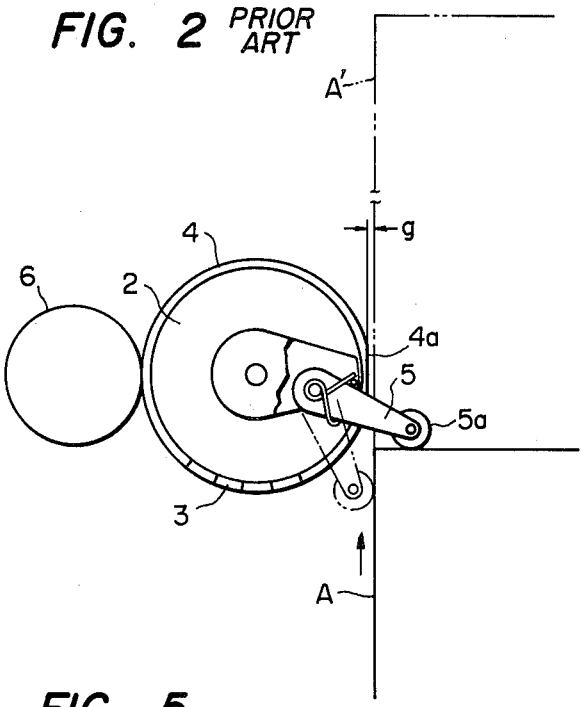
FIG. 2 PRIOR ART
FIG. 2 is a plan view of an essential part of the numbering printer shown in FIG. 1.
Figure 5:
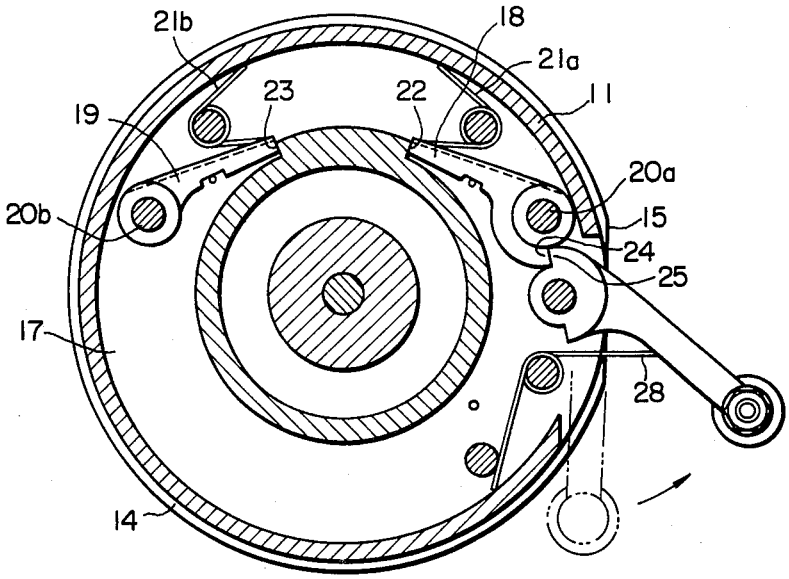
FIG. 5 is a cross-sectional view taken along a horizontal plane of the printer of FIG. 3.

As will be clearly understood from FIGS. 1 and 2, the ring band 4 has a partially flat-cut away portion at 4*a*, for avoiding any direct contact of the ring band 4 with package "A".

A motion feeler or motion-receiving arm 5 projects radially outwardly from the drum proper 2 at a position corresponding to the location of the cut away portion 4*a*.

Although not shown, a commonly known, one-push one-complete revolution drive mechanism is arranged within the interior of the drum 2. Such kind of drive mechanism is shown and described in the prior Japanese Utility Model Publications referred to previously.

For the operation of the foregoing known printer, a series of packages, only one thereof being shown only partially schematically at "A" in FIG. 2, are successively carried along in the direction of the arrow in FIG. 2 on a conveyor belt A'.

When one of the packages, as at A passes near-by the drum 2, it is brought into mechanical contact with contact roller 5*a* rotatably mounted on the tip end of feeler arm 5, as shown in full line in FIG. 2. The drum 2, together with its friction-contact ring band 4 is caused to rotate around its center, which is shown by a small circle in FIG. 2. Thus, the drive of the drum is initiated. At the initiation of this drum drive, the straight-cut portion 4*a* of frictional ring band 4 is positioned towards and parallel to the conveyor passage and kept at a small idle gap distance g therefrom.

Upon execution of a slight rotary motion of the drum thus caused, the initial portion of the serrated ring band 4 proper, in close proximity to said cutout, is brought into contact with the related one of the packages "A".

Although shown only schematically in FIG. 2, an inking roller 6 is rotatably provided on the arm 1 and in close proximity to the drum so as to contact with the protruding portion of the character array 3 during the rotational movement of the drum 2.

After the printing job by transferring an ink film from the array onto the package during a complete revolution of the drum 2, the latter will be caused to return to its initial ready-for-operational position shown in FIG. 2.

Next, referring to FIGS. 3–9, the inventive improvements over the foregoing conventional numbering printer shown in FIGS. 1 and 2, will be set forth in detail.

In these figures, numeral 10 represents only partially and even schematically the up-and-down slidable supporting arm which is similar to that illustrated at 1 in the foregoing.

Numeral 11 represents a printing drum which is similar to that shown at 2 in the foregoing.

12 denotes a character array that is the same as that denoted with 3 in the foregoing.

13 denotes a serrated or the like roughened or frictionally engageable ring band similar to what has been shown and described in the foregoing with respect to reference numeral 4. Numeral 13*a* is a straight cutout as was referred to hereinbefore with reference numeral 4*a*.

The printing drum 11 is provided at its upper end with a round supporting plate 14, a pair of frame members 15 being fixedly attached to the lower surface of the plate 14. The said character array 12 is supported by these frame members 15.

At the free end of the support arm 10, a stepwise rotatable numbering head unit 16 is suspended by fixing a positioning nut 108, said head unit having a sensing kick unit 39 provided with a roller 41, as well as a numbering mechanism 12 which cooperates with said inking roller.

The head unit 16 comprises a hollow cylinder 16, the bottom end thereof being closed by a bottom cover 16*a* and the upper end of the cylinder being detachably attached to a supporting plate 10. The preferably detachable attaching means such as screw connections for the connection of these three constituents 10, 14 and 16 have been omitted from the drawing for avoiding excess complexity thereof.

Supporting plate 14 is formed integrally with a vertically extending axial sleeve portion 17.

Numeral 18 represents a head suspension base which is fixedly connected with the said support arm 10, although the fixing means serving for this purpose have been omitted for simplicity of the drawing.

The sleeve 17 and the supporting base 18 are rotatable relative to each other.

On the upper surface of said plate 14, a mounting plate 19 is mounted fixedly, the latter supporting a rotation regulating mechanism to be described. Centrally of said plate 19, a central sleeve 20 is formed integrally with the former. This outer sleeve 20 is fitted tightly around the foregoing inner sleeve 17.

The serrated or the like friction-providing ring 13 is formed integrally with and dependingly from the outer peripheral portion of mounting plate 19, a casing member 21 being made integral with said mounting plate 19 at its upper part as shown.

Numeral 22 denotes a locking means which bridges between the sleeve portion 20 of mounting plate 19 and the sleeve 17. Numeral 27 denotes a hydraulic chamber which is hydraulically connected through a communication passage 26 with the lower end portion of a hollow cylinder chamber 23 which contains a movable hydraulic piston 24. There is provided an adjustable screw 25 adapted for manually regulating the normal position of the said hydraulic piston, which is being acted upon from above.

The hydraulic lock 22 is thus constituted by hydraulic chamber 23 formed for some distance centrally of sleeve portion 17, said hydraulic piston 24 slidably mounted therein; said adjustable screw 25; said communication passage 26 and said hydraulic chamber 27. As seen, this chamber 27 is formed in a part of the outer surface of the inside sleeve and closed from outside by the inside surface of outer sleeve 20. Naturally, a certain viscous oil is filled in this hydraulic chamber. Sealing rings 28 are provided for avoiding otherwise possible oil leakage from this hydraulic chamber.

A splined joint 29 is formed at the top end of a hollow shaft providing the aforementioned hydraulic piston chamber 23, said hollow shaft being mechanically coupled at its outer surface and at its intermediate point between the both ends with a stopper disc 30.

The stopper disc 30 is provided fixedly with a pin 31 depending from the lower surface of the former. There are formed a plurality of pin-receiving holes 32 arranged in a circle on the base 18, although only one thereof is shown. The pin is inserted into any selected one of said holes 32 for execution of a kind of angle adjustment to be described later.

By tightening the adjusting screw for increasing the mechanical urging pressure acting upon the hydraulic piston 24 which is caused thereby to extend further into the piston chamber, thereby the hydraulic pressure prevailing in chamber 27 becoming correspondingly higher and the said hydraulic lock acting between the related both members 17 and 20 being thereby increased.

A rotational movement regulating mechanism 33 is provided between the upper surface of mounting plate 19 and the lower surface of drum supporting base 18. This mechanism comprises a cam cylinder 34 made integral at the lower surface of said base 18, on the one hand, and stopper pieces 35*a* and 35*b* provided on the upper surface of said mounting plate 19. These stopper pieces are arranged in a mutually opposite way.

Figure 6:
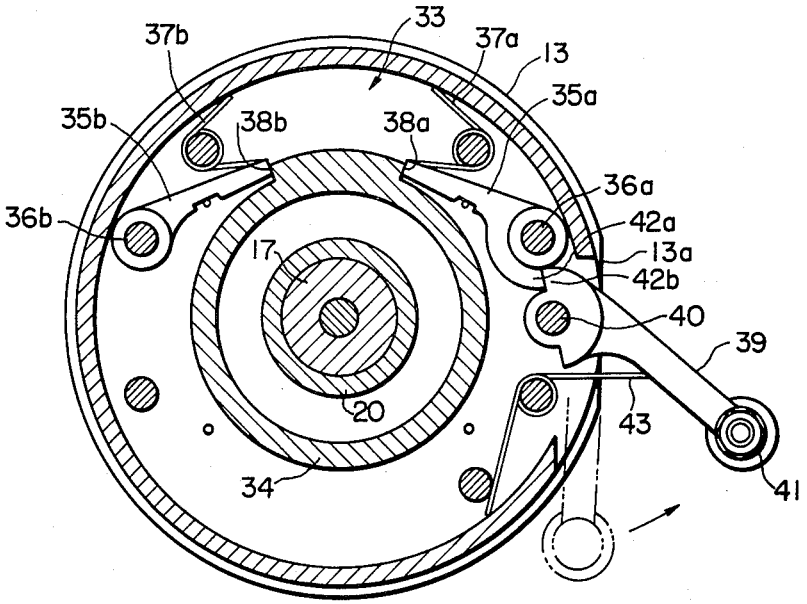
FIGS. 6 and 7 are cross-sections taken along planes spaced from the plane of FIG. 5.
Figure 7:
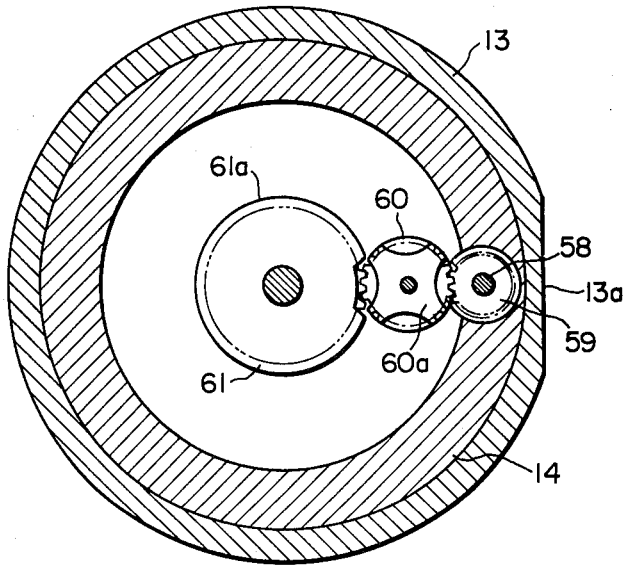

Springs 37*a* and 37*b* are provided so as to urge respectively these pawl-like stoppers 35*a* and 35*b* towards the outer surface of cam cylinder 34, as seen most clearly from FIG. 6.

Mutually opposite shoulders 38*a* and 38*b* are formed on the peripheral surface of cam cylinder 34 for cooperation with said stoppers or pawls 35*a* and 35*b*, respectively.

Motion-receiving arm 39 is rotatably mounted by means of a pin 40 on the upper surface of mounting plate 19 and in proximity to the root end of stopper 35*a*. As was briefly explained in the conventional basic arrangement by way of FIGS. 1 and 2, the protruding arm 39 projects radially outwardly and passes through the straight cutout region 13*a*.

Stopper pawl 35*a* is arranged to be rotatable around a pin 36*a* and formed at its root portion with a cam element 42*a*. In the similar way, the motion-receiving arm 39 is rotatable around its pivot pin 40 and has at its root end a cam member 42*b*. These cam members 42*a* and 42*b* cooperate with each other in one way only. Wire spring 43 urges said arm 39 to rotate in one direction only. This direction represents naturally the cam-engaging one.

As seen from the foregoing description, when the moving package "A" collides against the tip end of the arm or lever 39 through its shock-absorbing roller 41, stopper pawl 35*a* is caused to disengage from the corresponding cam-receiving shoulder 38*a*.

The digit- or character array 12 comprises a number of digit wheels 45*a*–45*f* which are rotatable around a common support shaft 44 rigidly supported at its both ends by the frame members 15. All these digit wheels are compacted as shown, so as to provide substantially similar, substantially ball-like outline configuration in resemblance in some respect with the outer surface of the numbering head, yet partially protruding slightly therefrom. Each digit wheel represents ten digits 0–9, as will be easily understood from the drawing. All digits are denoted with one and single reference numeral: 46, so far as FIGS. 3–9 are concerned.

Between each neighboring pair of digit wheels 45, a conventional carry-up mechanism 47 is provided. Thus, when a lower figure digit wheel has made a complete revolution, the next higher figure digit wheel is rotated one digit upwards.

Figure 8:
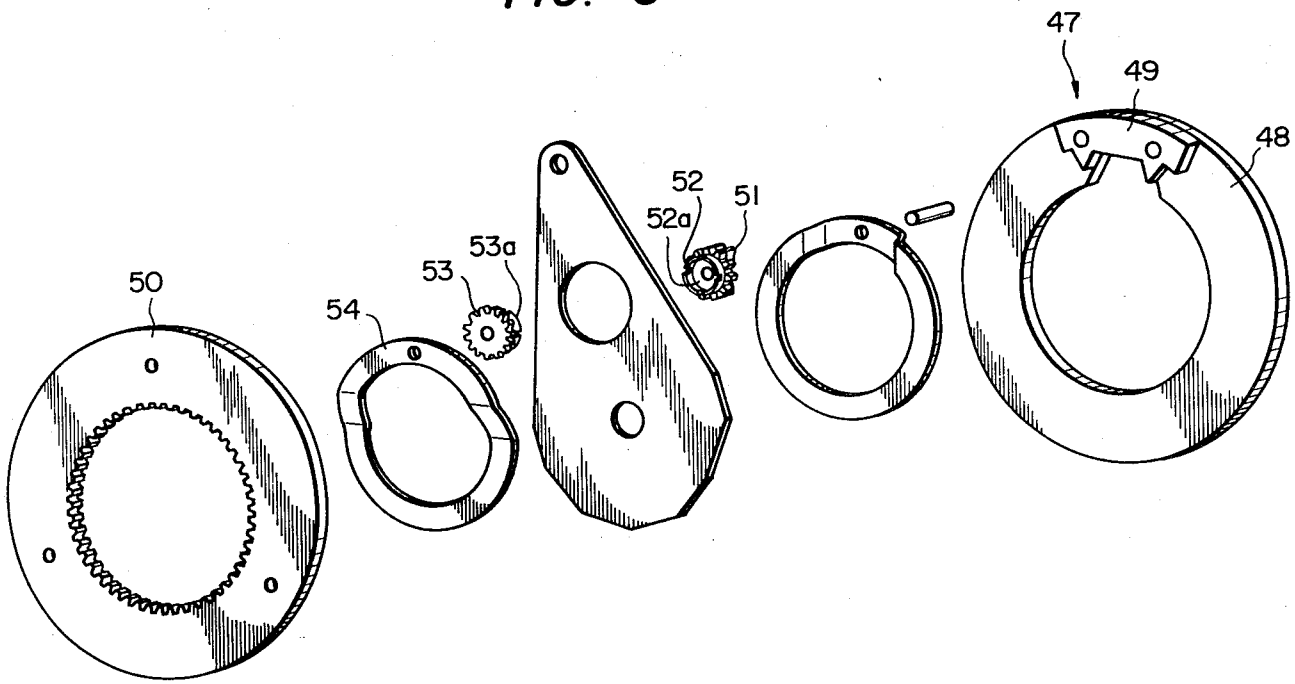
FIG. 8 is an exploded perspective view showing several main motion-transmitting elements.

An embodiment of such figure carry-up mechanism is shown in FIG. 8.

Since this kind of gear type carry-up mechanism is highly well known and does not constitute any part of the invention, an exploded perspective view of the constituents parts is shown only schematically in FIG. 8.

48 represents a ring-shaped segment to be provided at the lower figure side of the digit wheel; 49 denotes an intermittent internal pinion attached to said segment 48. 50 represents a continuous internal gear to be attached to higher figure digit wheel. 51 denotes a star wheel adapted for cooperation with the periphery of said segment 48. 52 represents a pinion to cooperate with intermittent internal pinion 49. 53 represents a pinion to cooperate with said continuous internal gear 50. Star wheel 51 and pinion 52 are made integral with each other. Sprocket wheels 52*a* and 53*a* operatively connect said both pinions 52 and 53 in the carrying-up direction only. Spring 54 urges pinion 53 towards pinion 52.

Numeral 55 denotes a gear adapted for the individual digit feed formed integrally with the least figure digit wheel 45*a*, said gear 55 being arranged to cooperate with digit feed gear mechanism 56.

As will be easily supposed the gear mechanism will feed the digit wheel 45*a* by one digit for each complete revolution of the drum 11.

The gear mechanism 56 comprises pinion 57 meshing with gear 55; drive shaft 58 rotatably mounted on frame 15 and carrying pinion 57 at its lower end; a connecting gear 59 fixed to upper end of said drive shaft 58; an intermittently operable gear 60 rotatably mounted on support plate 14 and meshing with gear 59; and an intermittent gear 61 meshing with said gear 60 within a predetermined rotational angle only. The said gear 61 is fixedly attached to the lower end of the hollow shaft-like elongated member 23*a* defining therein said hydraulic piston chamber. To the intermittent gear 60, star gear 60*a* is attached integrally. In the corresponding way, gear 61 is made integral with segment 61*a*. In this way, motion-stop angle of intermittently rotatable gear 60 is properly regulated.

In the printing and numbering assembly according to this invention, the printing drum 11 is prepositioned before operation in such a way that the straight cutout 13*a* is set in parallel to the package conveyor route.

Then, a package "A" is fed at a predetermined constant speed forward and brought into collision by its front and surface against the feeler arm 39, thereby motion being transmitted therefrom to stopper pawl 35*a* appearing at the rotation-regulating side so as to disengage the latter from notch or shoulder 38*a*. In this way and in unison with the advancing movement of the package "A", the printing drum is rotated about its central axis, while the friction-providing ring band 13 is caused to make a complete revolution in unison with the printing head. During this complete revolution of the latter, a number-printing job has been performed. Until the last moment of this complete revolution of the printing head, stopper pieces 35*a* and 35*b* will be returned again to their respectively engaged positions.

By the provision of straight cutout 13*a* formed at the serrated or the like friction-providing ring band 13 is positioned towards the package-traveling route A′ and making no direct contact with the latter in any way. After complete passage of the package from the working area of the printing head, the feeler arm 39 will be returned automatically under the action of the return spring.

During one complete revolution of printing drum 11, intermittent gear 60 will make a complete revolution around the intermittent gear 61 of digit feed gear mechanism 56, thereby the former making a predetermined angular movement and just one digit being fed forward at the lowest figure digit wheel 45*a*.

If it is desired to modify the facing angle of the printing mechanism or character array in relation with the stop angle of printing drum 11, the adjusting screw 25 is at first loosened, so as to reduce the hydraulic pressure prevailing in the chamber 27, resulting in unlock of the hydraulic locking means acting between sleeve 20 and support shaft 17.

At this stage, the facing angle of printing mechanism 12 can be adjusted without modifying the facing angle of the serrated ring band 13. When the necessary angular adjustment has been executed, the adjusting screw 25 is retightened, so as to provide a hydraulic lock between sleeve shaft 20 and support shaft 17.

Even with the printing block or digit wheel assembly 45*a* kept stationary, occasionally necessary angular adjustment can be brought into effect. In this case, stop plate 30 is manually elevated, so as to disengage the pin 31 from hole 32, and then properly rotated, accompanying sleeve shaft 23*a* and its lower end intermittent gear 61 being rotated. In this way, intermittent gear 60 will be correspondingly rotated, thereby the digit wheel assembly 45*a* being rotated correspondingly.

By adjusting the selected lock position of stop or lock plate 30, the facing angle of intermittent gear 61 can be altered, for providing similar adjustment of the digit wheel feed assembly.

The embodiments of the invention in which an exclusive property or privilege is claimed are as follows:

1. An automatic numbering printer assembly for applying indicia to articles conveyed along a conveying path comprising:

a support arm;

a head suspension base carried by said support arm;

a printing drum supporting plate carried by and rotatable with respect to said head suspension base;

a printing drum carried by and rotatable with said supporting plate, said printing drum including a successively numbering digit wheel unit for applying indicia to an article moving past said printer assembly, said digit wheel unit having indicia applying means advanceable unit by one unit;

a mounting plate supported by said supporting plate, said mounting plate having an outer peripheral portion forming a friction-providing ring positionable so as to be engaged by articles moving along the conveying path so that said mounting plate is rotated one complete revolution by an article moving past said printer assembly;

locking means including a hydraulic lock for interconnecting said supporting plate and said mounting plate so that said supporting plate and said printing drum carried by said supporting plate are rotated one complete revolution when said mounting plate is rotated one complete revolution by an article moving past said printer assembly, rotation of said printing drum resulting in said digit wheel unit applying indicia to the moving article, said supporting plate being rotatable with respect to said mounting plate upon release of said locking means so as to permit angular adjustment of said supporting plate with respect to said mounting plate to thereby adjust the angular position of said printing drum;

a first gear rotatably mounted on said supporting plate for advancing said digit wheel unit by one unit during one complete revolution of said supporting plate;

a shaft rotatably supported by said supporting plate;

a second gear carried by and rotable with said shaft, said second gear meshing with said first gear so that rotation of said shaft rotates said first gear thereby advancing said digit wheel unit; and engagement means movable between first and second positions for selectively interconnecting said shaft for rotation with said supporting plate, said shaft when said engagement means is in the first position being rotated when the interconnected supporting plate and mounting plate are rotated by articles moving past said mounting plate, said shaft when said engagement means is in the second position being rotatable with respect to said supporting plate without movement of said supporting plate.

2. A printer assembly according to claim 1, wherein said supporting plate has a vertically extending axial sleeve portion, and wherein said mounting plate has a central sleeve fitted tightly around said sleeve portion, said hydraulic lock having a chamber disposed between confronting surfaces of said sleeve portion and said central sleeve, said locking means including means for increasing the pressure in said chamber to thereby interconnect said supporting plate and said mounting plate and for decreasing the pressure in said chamber to thereby permit relative movement between said supporting plate and said mounting plate.

* * * * *